US009541250B2

(12) United States Patent
Japs et al.

(10) Patent No.: US 9,541,250 B2
(45) Date of Patent: Jan. 10, 2017

(54) PLASTIC COVER LENS OF A HEADLAMP HAVING A BACKING STRIP DISPOSED ON THE EXTERIOR

(71) Applicant: Hella KGaA Hueck & Co., Lippstadt (DE)

(72) Inventors: Eduard Japs, Herford (DE); Lars Tillmann, Lippstadt (DE)

(73) Assignee: HELLA KGAA HUECK & CO., Lippstadt (DE)

( * ) Notice: Subject to any disclaimer, the term of this patent is extended or adjusted under 35 U.S.C. 154(b) by 50 days.

(21) Appl. No.: 14/597,130

(22) Filed: Jan. 14, 2015

(65) Prior Publication Data

US 2015/0204500 A1 Jul. 23, 2015

(30) Foreign Application Priority Data

Jan. 21, 2014 (DE) ..... 10 2014 100 600

(51) Int. Cl.
*F21S 8/10* (2006.01)

(52) U.S. Cl.
CPC ..... *F21S 48/155* (2013.01); *F21S 48/1233* (2013.01)

(58) Field of Classification Search
CPC ... F21S 48/1208; F21S 48/1225; F21S 48/155
See application file for complete search history.

(56) References Cited

U.S. PATENT DOCUMENTS 5,180,219 A * 1/1993 Geddie ..... F21S 48/1233 362/267

FOREIGN PATENT DOCUMENTS

| | | | |
|---|---|---|---|
| DE | 1019622 | B | 11/1957 |
| DE | 102004026467 | A1 | 12/2005 |
| DE | 102004025232 | A1 | 1/2006 |
| DE | 102010010413 | A1 | 9/2011 |
| DE | 102010056412 | A1 | 6/2012 |
| DE | 102011050163 | A1 | 11/2012 |
| DE | 102012102922 | A1 | 10/2013 |

* cited by examiner

*Primary Examiner* — Thomas M Sember
(74) *Attorney, Agent, or Firm* — Husch Blackwell LLP

(57) ABSTRACT

An assembly comprising a strip on the exterior of a plastic cover lens for a headlamp. Locking means are formed on the exterior of the plastic cover lens, which extend diagonally, in a transverse direction, from the surface of the plastic cover lens, and that the strip is designed as a backing strip and exhibits locking means receivers in which the locking means engage. At least one snapping means is provided on the backing strip and one complementary snapping means is provided on the plastic cover lens in order to secure the backing strip in the transverse direction (Y).

9 Claims, 3 Drawing Sheets

PLASTIC COVER LENS OF A HEADLAMP HAVING A BACKING STRIP DISPOSED ON THE EXTERIOR

CROSS REFERENCE

This application claims priority to German Application No. 10 2014 100600.3, filed Jan. 21, 2014, which is hereby incorporated by reference.

FIELD OF TECHNOLOGY

The present invention relates to an assembly comprising a strip on the exterior surface of a plastic cover lens for a headlamp.

BACKGROUND

DE 10 2004 025 232 A1 shows a strip disposed on the exterior of a plastic cover lens for a headlamp, and the strip is designed thereby as a decorative trim, and is affixed to the exterior of the plastic cover lens with a casting compound.

In order to attach the strip, the plastic cover lens has an attachment section with an attachment extension, and the end edge of the attachment extension forms a type of ridge that is uneven, and because of this uneven surface, into which the casting compound is cast, a permanent, precise positioning of the strip is obtained on the exterior of the plastic cover lens when the casting compound hardens. Disadvantageously, it is difficult to replace the strip if, for example, it becomes damaged. Furthermore, there is the disadvantage that in order to mount the strip on the exterior of the plastic cover lens, a hardening time for the casting compound must be taken into account, and the strip must be fixed in position, accordingly, over the course of time during which the casting compound hardens.

Alternative assemblies for strips on the exteriors of plastic cover lenses are enabled in that screw sockets are formed on the exterior of the plastic cover lens, into which screw can be screwed, by means of which screws the strip can be attached to the exterior of the plastic cover lens. The screw sockets can then be covered by the strip. Disadvantageously, as a result of attaching the strip by means of screws, the screw sockets are subjected to a mechanical tension, in particular when self-tapping screws are used, which are screwed into the screw sockets. When cleaning agents, such as those also used for cleaning plastic cover lenses for headlamps on vehicles, are applied to the cover lenses, the screw sockets may prematurely exhibit signs of wear, which is to be avoided.

Strips that are to be attached to the exteriors of headlamps may run over the exterior of the plastic cover lens, depending on the design concept of a vehicle, and can also be placed there in order to separate light functions of the headlamp, for example, and the aim thereby is to dispose a strip on the exterior of a plastic cover lens such that it is permanently attached thereto, at a precise positioning thereof, which can be replaced in a simple manner.

If the strip becomes damaged, it should be possible to remove this strip from the plastic cover lens in a simple manner, and moreover, it should be the case that the retaining geometries on the exterior of the plastic cover lens, in particular as an alternative to a screw socket, are not subjected to excessive mechanical tensions, in order to ensure a permanent retention of the strip on the plastic cover lens.

SUMMARY OF THE INVENTION

The objective of the invention is thus to further improve an assembly in which a strip is disposed on the exterior of a plastic cover lens for a headlamp, which is designed in a simple manner, and with which the strip can be replaced in a simple manner. In particular, the objective is to further develop the manner in which the strip is disposed such that attachment means on the plastic cover lens are not subjected to excessive mechanical tensions.

This objective is obtained, based on an assembly comprising a strip on the exterior of a plastic cover lens for a headlamp in accordance with the preamble of claim 1 in conjunction with the characterizing features thereof. Advantageous further developments of the invention are defined in the dependent claims.

The invention includes the technical teaching that locking means are formed on the exterior of the plastic cover lens, which extend diagonally outward from the surface of the plastic cover lens, facing in a transverse direction, and it is provided that the strip is designed as a backing strip, and exhibits locking means receivers in which the locking means engage, wherein, furthermore, at least one snapping means is provided on the backing strip and one complementary snapping means is provided on the plastic cover lens in order to secure the backing strip in the transverse direction.

With the design of the strip as a backing strip, and the inventive assembly of the backing strip on the exterior of the plastic cover lens, which can be designed to receive elements in a replaceable manner, the substantial advantage is obtained that a casting compound is no longer necessary in order to create a connection of the backing strip with the plastic cover lens. Furthermore, there is the advantage that no particularly high mechanical tension is generated in the locking means for the backing strip assembly, as is the case when a screw is screwed into a screw socket, for example. The locking means can advantageously be designed such that the backing strip engages with locking means receivers in a form-locking manner with the locking means, without particularly high local mechanical tensions being generated in the locking means or the locking means receivers. For this, the locking means is inventively designed with an extension direction, which runs in a transverse direction, and the locking means extends diagonally from the surface of the plastic cover lens. The locking means can be defined thereby with a main extension direction, meaning that it extends from the surface of the plastic cover lens at an angle greater than 0° and less than 90°, wherein the diagonal can exhibit a component in the transverse direction, and a further component in the direction of the norm in relation to the plastic cover lens.

If the backing strip is locked in place on the locking means by means of the locking means receivers, then a snapping means is locked in place in a complementary snapping means according to the invention, by means of which the backing strip is tightened to the locking means such that it cannot move in the transverse direction.

The snapping means and the complementary snapping means can be designed as simple locking or clip connections.

If the snapping means is released from the complementary snapping means, the backing strip can be readily removed from the plastic cover lens, in order, for example, to replace a damaged backing strip with a new backing strip.

The locking means can have a cross-section geometry in the manner of a keyhole, formed such that it is transverse to a longitudinal extension. This cross-section geometry in the manner of a keyhole contains, in particular, a head section and a neck section, wherein the head section is wider than the neck section. As a result, there is the possibility of using the form-locking connection between the locking means and the locking means receivers obtained by the wider shape of the head section in comparison with the neck section, such that the locking means receiver engages behind the head section, toward the neck section. The form-locking connection formed in this manner is then secured when the snapping means is locked in place in the complementary snapping means.

The head section can extend diagonally from the surface of the plastic cover lens, wherein the neck section can extend in the manner of a rib between the head section and the surface of the plastic cover lens. Locking means are created by the design in the manner of a keyhole, which can be heavily loaded mechanically, and by this means, the occurrence of high mechanical tensions in the locking means themselves is avoided, which can occur, for example, when an external body exerts a force on the backing strip, when, for example, an external body comes in contact with the vehicle.

With the formation of a neck section there is the further advantage that, in addition to securing the backing strip in the transverse direction, it is also secured in a vertical direction, because the contact regions of the locking means receivers in the backing strip can rest against the neck section, wherein a securing of the backing strip in the direction of the norm in relation to the plastic cover lens, which can, for example, correspond to the longitudinal direction of a vehicle, is established by the form-locking connection of the locking means receivers at the head section.

Advantageously, the locking means receiver is formed on the mounting surface of the backing strip as a substantially U-shaped recess, wherein the U-shaped recess is formed such that it corresponds to the diagonal extension of the locking means. The locking means receivers can be formed as an integral part of the body of the backing strip thereby, and the locking means receivers can be manufactured together with the body of the backing strip in an injection molding process, as an integral part thereof.

According to one advantageous design, a decorative trim can be disposed on the backing strip, which has, for example, a galvanized chrome surface, and which can extend from the plastic cover lens in the manner of a design element.

The U-shaped recess can encompass the locking means in the transition region between the head section and the neck section in the manner of a pair of legs, and the U-shaped recess is pushed onto the keyhole geometry via the open end of the U-shape. When the edge of the backing strip lies on the surface of the plastic cover lens, the snapping means is then locked in place on the complementary snapping means, resulting thereby in a fixed assembly of the backing strip on the plastic cover lens.

The locking means present on the plastic cover lens and/or at least in part on the surrounding region on the surface of the plastic cover lens can have a protective lacquer, and due to the prevention of mechanical tension peaks during the attachment of the backing strip by means of the locking means designed according to the invention, there is the advantage that a protective lacquer of this type will not be damaged.

In the transition between the surface of the plastic cover lens and the locking means formed thereon, and/or in the transition between the head section and the neck section, respective radii can be formed. As a result, not only are the locking means on the exterior of the plastic cover lens designed such that they can be produced by means of injection molding, but moreover, there is the advantage with this design, with regard to mechanical tensions, that mechanical tension peaks are minimized by means of the radii. In particular, a radius can be provided in the throat, between the neck section and the head section, which corresponds to a radius of the leg-type U-shaped recess of the locking means receivers on the backing strip. As a result, a surface contact between the locking means receivers and the locking means is established, which can be more heavily loaded than, for example, a linear contact.

The invention furthermore relates to a headlamp for a vehicle, having a plastic cover lens, on the exterior of which a strip is disposed, wherein locking means are formed on the exterior of the plastic cover lens, which extend diagonally from the surface of the plastic cover lens, facing a transverse direction, wherein the strip is designed as a backing strip, and has locking means receivers in which the locking means engage, and wherein, furthermore, at least one snapping means is provided on the backing strip and a complementary snapping means is provided on the plastic cover lens, which serve to secure the backing strip in the transverse direction. The other features and advantages associated therewith, which are described above in conjunction with the assembly for attaching the backing strip to the plastic cover lens, are to be given the same consideration for the inventive headlamp.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
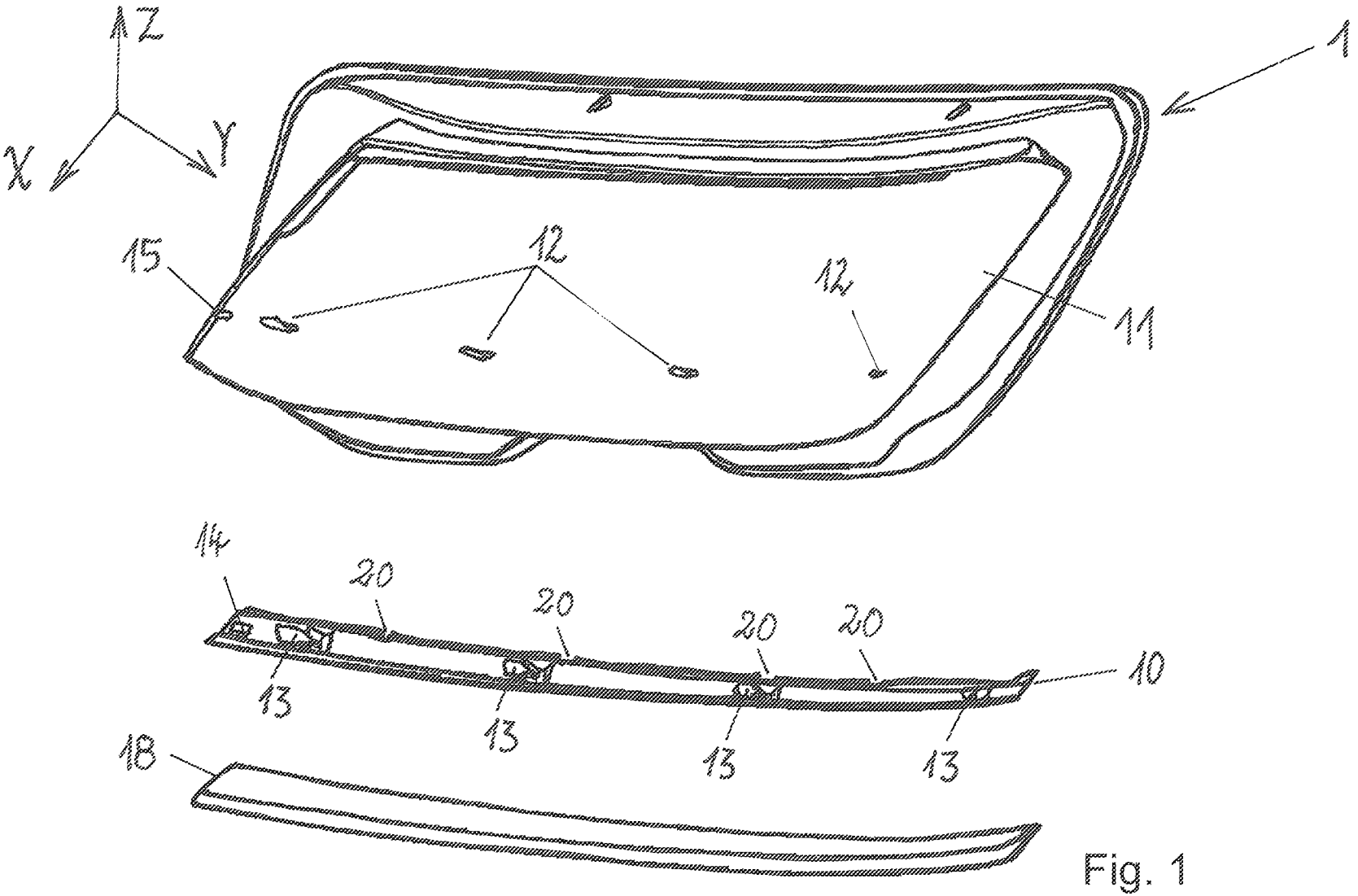
FIG. 1 is a perspective view of a plastic cover lens, a backing strip, and a decorative trim in an uninstalled assembly state.

FIG. 1 shows one embodiment example for the formation of an assembly 1 comprising a backing strip 10 on the exterior of a plastic cover lens 11 for a headlamp, which, for example, can be installed in a vehicle. The plastic cover lens 11 has an edge region, which serves for the connection with the housing for the headlamp, and an inner, likewise basically frame-shaped, region serves for the formation of a surface through which light passes. A coordinate system shows the longitudinal direction X, which corresponds to the light projection direction of the light, which can be provided by the headlamp, and the longitudinal direction X forms, in particular, a longitudinal direction of the vehicle. The transverse direction Y forms a direction transverse to the longitudinal direction X in front of the headlamp, and the vertical direction of the headlamp is indicated by Z.

The backing strip 10 is shown in an exploded view in front of the plastic cover lens 11, which is to be disposed on the front surface plastic cover lens 11, over the region through which the light passes. The backing strip 10 serves as a receiving strip, to which, for example, the decorative trim 18, which is depicted in front of the backing strip 10 in the exploded view, can be attached in a replaceable manner.

Locking means 12 serve for the assembly of the backing strip 10 on the exterior of the plastic cover lens 11, which are formed on the exterior of the plastic cover lens 11 as an integral part thereof. The locking means 12 extend basically in the transverse direction Y, whereby they extend diagonally from the surface of the plastic cover lens 11. The diagonal extension of the locking means 12 in the transverse direction Y results from the slanted installation situation of the plastic cover lens 11, transverse to the longitudinal direction X of the vehicle. The locking means 12 serve to lock the locking means receivers 13 in place, said receivers being located on the mounting surface of the backing strip 10.

By way of example, numerous locking means 12 are shown, disposed on a common horizontal plane, wherein a complementary snapping means 15 is provided on the exterior of the plastic cover lens 11, disposed at basically the same height as the locking means 12. The backing strip 10 can be secured in the transverse direction Y with the complementary snapping means 15, in an assembly that is locked in place on the locking means 12, in that a snapping means 14 located on the backing strip 10 is snapped into the complementary snapping means 15.

The backing strip 10 forms a receiving means for receiving various elements, such as a decorative trim 18, for example, which forms a galvanized chrome design panel, and which is designed as a single piece. The backing strip 10 is designed such that, by means of the inventive assembly 1, it can be attached in a releasable manner to the plastic cover lens 11, wherein, in particular, the use of a casting compound is to be avoided. The connection of the decorative trim 18 to the backing strip 10 can be obtained by means of clip connections 20, which are indicated on the edge of the backing strip 10.

Figure 2:
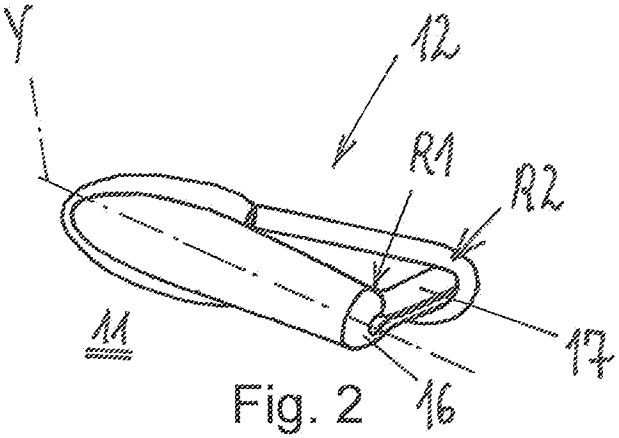
FIG. 2 is a detail view of a locking means.

FIG. 2 shows a detail view of a locking means 12, viewed from a diagonal perspective, from which the locking means 12 extends from the plastic cover lens 11. The locking means 12 extends with a main section in a transverse direction Y, and the locking means 12 exhibits a cross-section geometry in the manner of a keyhole in the main extension direction formed thereby. The keyhole geometry can be divided into a head section 16 and a neck section 17, wherein the head section 16 extends basically in the manner of a cylinder in the transverse direction Y, and the neck section 17 forms a rib-like connecting region between the contact cross-section surface on the exterior of the plastic cover lens 11 and the head section 16. A radius R1 is provided in the transition between the head section 16 and the neck section 17, and a radius R2 is provided in the transition of the neck section 17 to the exterior surface of the plastic cover lens 11.

Figure 3:
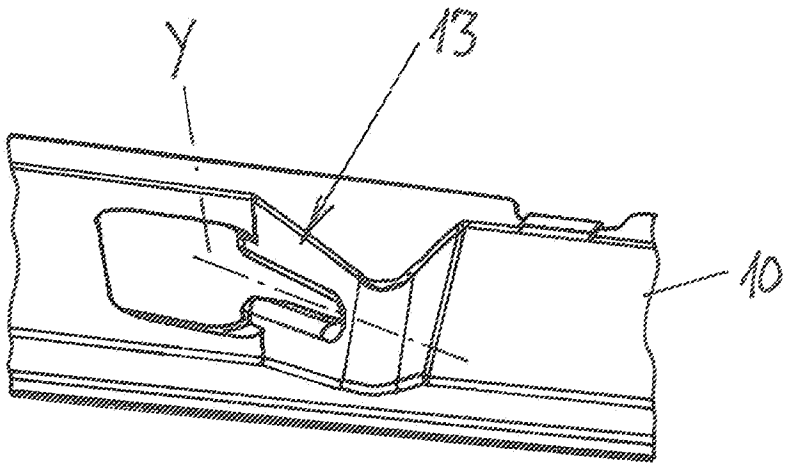
FIG. 3 is a detail view of a locking means receiver, on the mounting surface of the backing strip.
Figure 4:
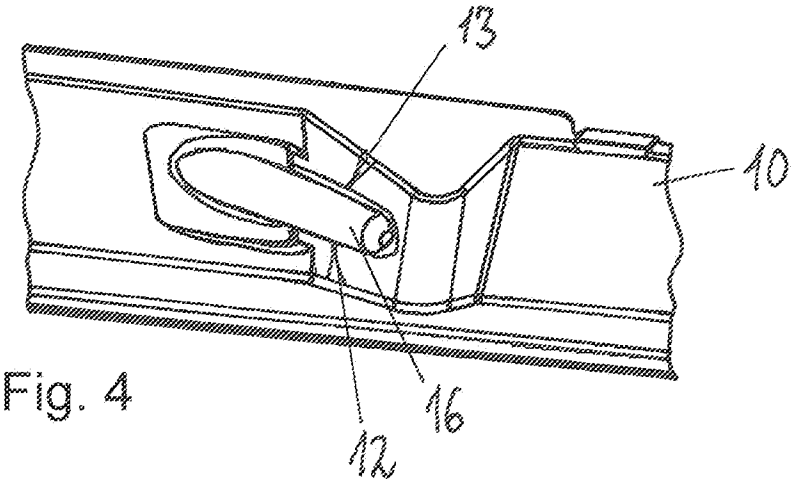
FIG. 4 is a detail view of the locking means, without a depiction of the plastic cover lens, in an assembled state in the locking means receiver, on the mounting surface of the backing strip.

FIG. 3 shows the design for a locking means receiver 13 on the mounting surface of the backing strip 10. The locking means receiver 13 forms a U-shaped recess, corresponding to the diagonal extension of the locking means 16 in the transverse direction Y. If the backing strip 10 is placed on the exterior surface of the plastic cover lens 11, then the U-shaped recess encompasses the transition region between the head section 16 and the neck section 17, as is depicted in FIG. 4. The legs of the U-shaped recess interact thereby with the radius region R1, and it is possible for the locking means receiver 13 on the mounting surface of the backing strip 10 to engage behind the head section 16 of the locking means 12, by means of which a form-locking connection is obtained between the locking means 12 and the locking means receiver 13.

FIG. 4 shows the locking means 12 in a section of the backing strip 10, inserted in the locking means receiver 13, by means of which it can be seen that the U-shaped recess of the locking means receiver 13 engages behind the head section 16 of the locking means 12.

Figure 5:
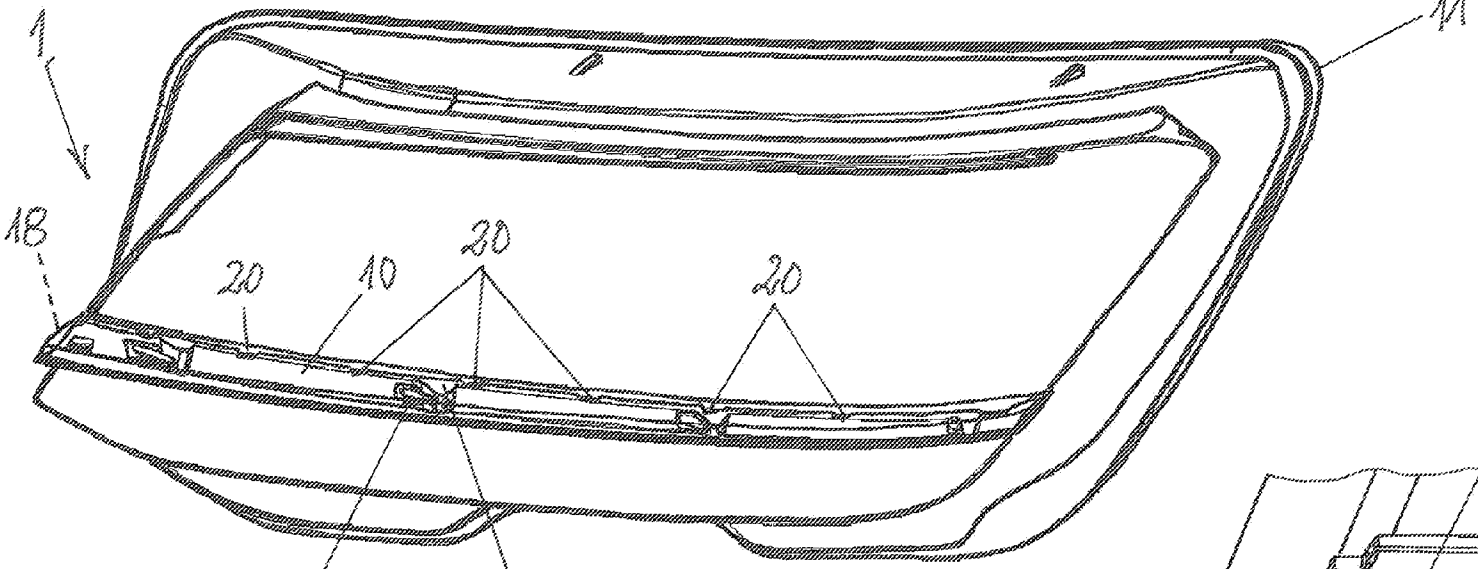
FIG. 5 is the perspective view of the plastic cover lens with a backing strip mounted on the exterior thereof, and a decorative trim, depicted in a transparent manner.

FIG. 5 shows the assembly 1 comprising the backing strip 10 on the exterior of the plastic cover lens 11, with the locking mean 12 inserted in the locking means receivers 13. A decorative trim 18, depicted in a transparent manner, is disposed on the backing strip 10, which is attached to the backing strip 10 by means of clip connections 20. The decorative trim 18 can be removed from the backing strip 10 due to the simple manner of attachment, and thus can be replaced, as is also the case with the backing strip 10 itself.

Figure 6:
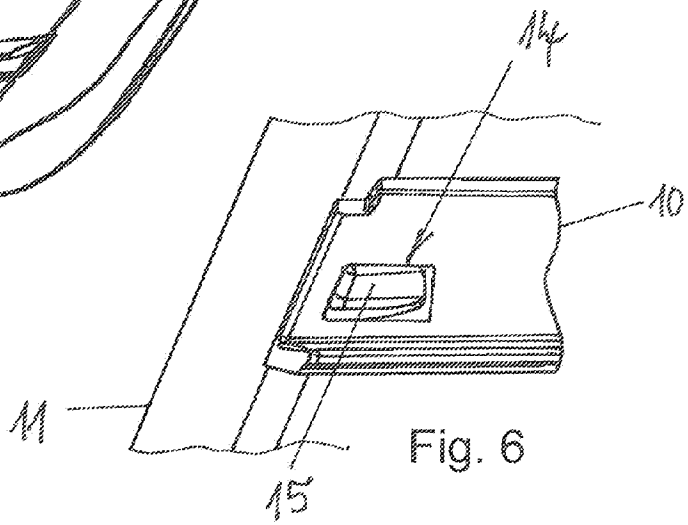
FIG. 6 is the assembly comprising a snapping means that is locked in place in a complementary snapping means.

Lastly, FIG. 6 shows the locking in place of the snapping means 14, designed as a recess in the backing strip 10, in a complementary snapping means 15, which is designed as a molding on the exterior of the plastic cover lens 11. According to the principle of a snap-in hook, the backing strip 10 can thus be fixed in the transverse direction Y, counter to the extension direction of the locking means 12, such that in the end, the backing strip 10 can be accommodated on the plastic cover lens 11 in a form-locking manner, via the locking means 12 and the locking means receivers 13, and is secured via the locking in place of the snapping means 14 in the complementary snapping means 15. The complementary snapping means 15, designed as a lug, is thus locked in place in the snapping means 14, designed as a recess in the manner of a window.

The invention is not limited in terms of its embodiments to the preferred embodiment example defined above. Instead, a number of variations are conceivable, which also make use of the depicted solution in fundamentally different embodiments. All of the features and/or advantages that can be derived from the claims, description or drawings, including structural details, spatial configurations, and method steps, can be regarded as substantial to the invention, both in and of themselves, as well as in the various combinations thereof.

LIST OF REFERENCE SYMBOLS

1 assembly
10 backing strip
11 plastic cover lens
12 locking means
13 locking means receiver
14 snapping means
15 complementary snapping means
16 head section
17 neck section
18 decorative trim
19 galvanized chrome surface
20 clip connection
X longitudinal direction
Y transverse direction
Z vertical direction
R1 Radius
R2 Radius

The invention claimed is:

1. An assembly comprising:

a plastic cover lens for a headlamp;

a plastic backing strip for selective attachment to said plastic cover lens;

locking means formed on an exterior surface of the plastic cover lens, said locking means extending diagonally and facing in a transverse direction from the exterior surface of the plastic cover lens;

locking means receivers formed on a mounting surface of the backing strip in which the locking means engage;

at least one snapping means provided on the mounting surface of the backing strip, said at least one snapping means separate and distinct from said locking means receivers; and at least one complementary snapping means provided on the plastic cover lens, said at least one complementary snapping means separate and distinct from said locking means, for securing the backing strip in the transverse direction.

2. The assembly according to claim 1, wherein the locking means has a cross-section geometry in the shape of a keyhole, formed at a right angle to a longitudinal extension thereof, wherein the cross-section geometry includes a head section and a neck section.

3. The assembly according to claim 2, wherein the head section extends diagonally from the surface of the plastic cover lens, and wherein the neck section extends in the manner of a bridge between the head section and the surface of the plastic cover lens.

4. The assembly according to claim 2 wherein radii are formed, respectively, in at least one of the transition between the surface of the plastic cover lens and the locking means formed thereon, and in the transition between the head section and the neck section.

5. The assembly according to claim 1 wherein the locking means receiver is designed as a substantially U-shaped recess on the backing strip, wherein the U-shaped recess is designed such that it corresponds to the diagonal extension of the locking means.

6. The assembly according to claim 5, wherein the U-shaped recess encompasses the locking means in the transition region between the head section and the neck section in the manner of a pair of legs.

7. The assembly according to claim 1 wherein a protective lacquer is applied to at least the locking means or at least partially to the surface of the plastic cover lens.

8. The assembly according to claim 1 wherein a decorative trim is disposed on the backing strip, the decorative trim having a galvanized chrome surface.

9. The assembly according to claim 8, wherein clip connections are formed between the backing strip and the decorative trim, by means of which the decorative can be attached to the backing strip.

* * * * *